US007352324B2

(12) United States Patent
Mohamadi

(10) Patent No.: US 7,352,324 B2
(45) Date of Patent: Apr. 1, 2008

(54) PHASE MANAGEMENT FOR BEAM-FORMING APPLICATIONS

(76) Inventor: Farrokh Mohamadi, 8 Halley, Irvine, CA (US) 92612-3797

( * ) Notice: Subject to any disclaimer, the term of this patent is extended or adjusted under 35 U.S.C. 154(b) by 86 days.

(21) Appl. No.: 11/360,050

(22) Filed: Feb. 22, 2006

(65) Prior Publication Data

US 2006/0152416 A1 Jul. 13, 2006

Related U.S. Application Data

(60) Continuation of application No. 11/209,165, filed on Aug. 22, 2005, which is a division of application No. 10/860,526, filed on Jun. 3, 2004, now Pat. No. 6,982,670.

(60) Provisional application No. 60/476,248, filed on Jun. 4, 2003.

(51) Int. Cl.
*H01Q 3/26* (2006.01)
*H01Q 9/04* (2006.01)

(52) U.S. Cl. ..... 342/372; 343/700 MS

(58) Field of Classification Search ..... 342/154, 342/368, 372, 373; 343/700 MS
See application file for complete search history.

(56) References Cited

U.S. PATENT DOCUMENTS

2003/0003887 A1* 1/2003 Lim et al. ..... 455/147

* cited by examiner

*Primary Examiner*—Dao Phan
(74) *Attorney, Agent, or Firm*—Jonathan W. Hallman; MacPherson Kwok Chen & Heid LLP

(57) ABSTRACT

A beam-forming antenna system include a substrate; a plurality of mixers formed in the substrate; a phase generator formed in the substrate; and a plurality of antennas formed adjacent the substrate, wherein each mixer is coupled to a corresponding at least one of the antennas, and wherein the phase generator is operable to provide a plurality of uniquely-phased LO signals, each mixer being coupled to the phase generator to receive a different one of uniquely-phased LO signals such that an RF signal received by the antennas is phase-shifted through the mixers according to the unique phases of the LO signal to form a plurality of phase-shifted IF signals.

6 Claims, 10 Drawing Sheets

PHASE MANAGEMENT FOR BEAM-FORMING APPLICATIONS

RELATED APPLICATIONS

This application is a continuation of U.S. application Ser. No. 11/209,165, filed Aug. 22, 2005, which is a Divisional Application of U.S. patent application Ser. No. 10/860,526, filed Jun. 3, 2004, now U.S. Pat. No. 6,982,670 which claims the benefit of U.S. Provisional Application No. 60/476,248, filed Jun. 4, 2003. The contents of these applications are hereby incorporated by reference in their entirety.

TECHNICAL FIELD

The present invention relates generally to beam forming applications, and more particularly to a phase generation and management technique for a beam-forming phased-array antenna system.

BACKGROUND

Conventional high-frequency antennas are often cumbersome to manufacture. For example, antennas designed for 100 GHz bandwidths typically use machined waveguides as feed structures, requiring expensive micro-machining and hand-tuning. Not only are these structures difficult and expensive to manufacture, they are also incompatible with integration to standard semiconductor processes.

As is the case with individual conventional high-frequency antennas, beam-forming arrays of such antennas are also generally difficult and expensive to manufacture. Conventional beam-forming arrays require complicated feed structures and phase-shifters that are incompatible with a semiconductor-based design. In addition, conventional beam-forming arrays become incompatible with digital signal processing techniques as the operating frequency is increased. For example, at the higher data rates enabled by high frequency operation, multipath fading and cross-interference becomes a serious issue. Adaptive beam forming techniques are known to combat these problems. But adaptive beam forming for transmission at 10 GHz or higher frequencies requires massively parallel utilization of A/D and D/A converters.

To address these problems, injection locking and phase-locked loop techniques have been developed for an array of integrated antenna oscillator elements as disclosed in U.S. Ser. No. 10/423,160, (the '160 application) the contents of which are hereby incorporated by reference in their entirety. The '160 application discloses an array of integrated antenna elements, wherein each antenna element includes a phase-locked loop (PLL) that uses the antenna as a resonator and load for a voltage-controlled oscillator (VCO) within the PLL. The VCOs within each antenna element are slaved to a common reference clock that is distributed using phase adjustment circuitry rather than a traditional corporate feed network. The phase of each VCO can be changed relative to the reference clock by adjusting the VCO's tuning voltage such that some or all of the antenna elements become injection locked to each other. Although injection locking provides an efficient beam steering technique, a need in the art exists for improved techniques of actively phasing such antenna elements to provide a desired beam direction.

SUMMARY

In accordance with one aspect of the invention, a beam forming system is provided on a substrate. The system includes a plurality of mixers formed in the substrate; a phase generator formed in the substrate; and a plurality of antennas formed adjacent the substrate, wherein each mixer is coupled to a corresponding at least one of the antennas, and wherein the phase generator is operable to provide a plurality of uniquely-phased LO signals, each mixer being coupled to the phase generator to receive a different one of uniquely-phased LO signals such that an RF signal received by the antennas is phase-shifted through the mixers according to the unique phases of the LO signal to form a plurality of phase-shifted IF signals.

The invention will be more fully understood upon consideration of the following detailed description, taken together with the accompanying drawings.

DETAILED DESCRIPTION

Figure 1:
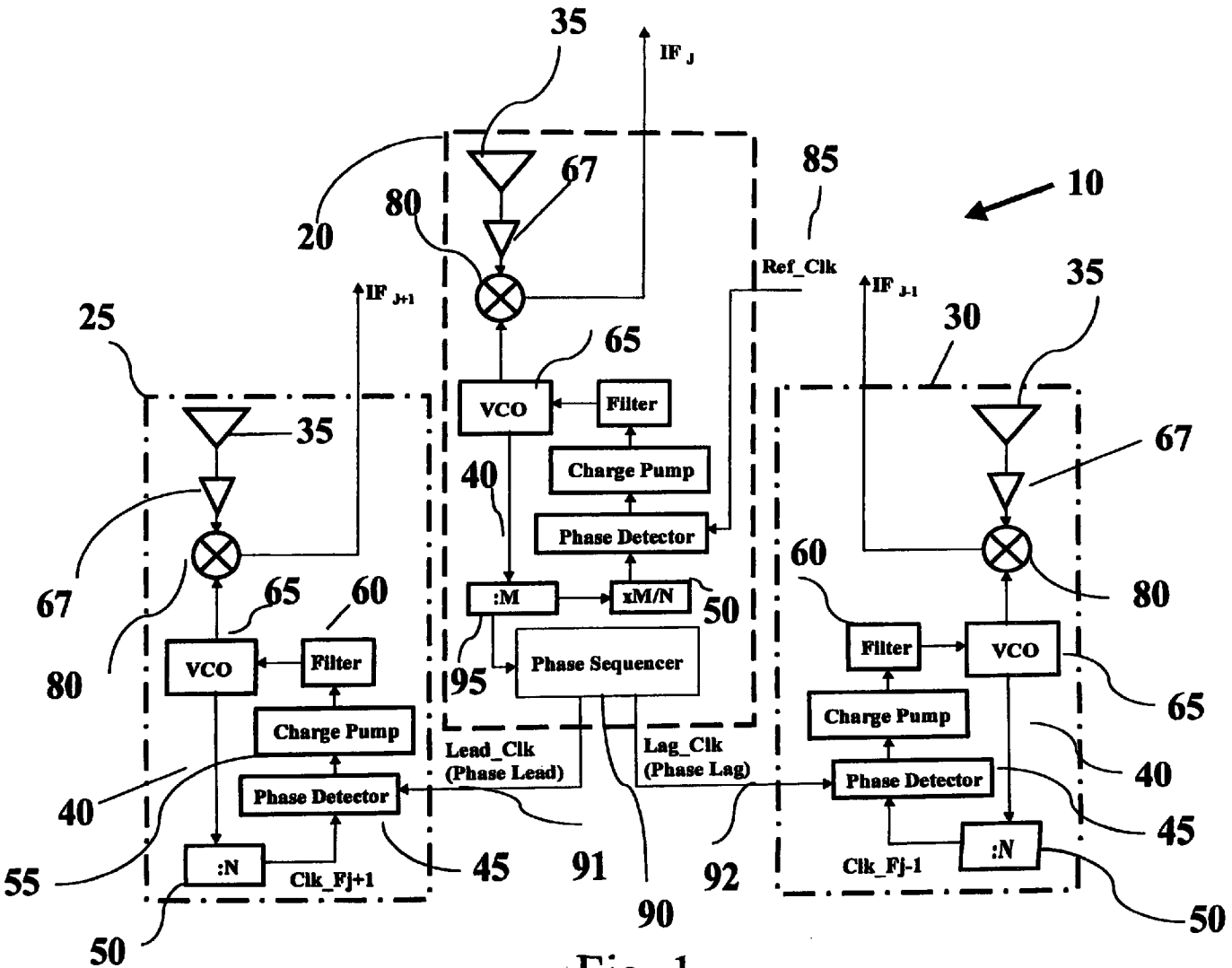
FIG. 1 is a block diagram of a phased antenna array including a phase management system according to one embodiment of the invention.

As seen in FIG. 1, an antenna array 10 is formed from an array of integrated antenna circuits such as a reference antenna circuit 20 and slave antenna circuits 25 and 30. Each integrated antenna circuit includes an antenna 35 that acts as a resonator and load for a self-contained phase-locked loop (PLL) 40. As known in the PLL arts, there are a variety of architectures that perform the essential function of a PLL: maintaining an output signal synchronous with a reference signal. In the embodiment illustrated in FIG. 1, each PLL 40 includes a phase detector 45 that receives as inputs a divided signal from a loop divider 50 and a reference signal. Phase detector 45 compares the phases of these input signals and adjusts input currents provided to a charge pump 55 accordingly. If the divided signal from loop divider 50 lags the reference input, charge pump 55 charges a first capacitor (not illustrated) in a loop filter 60 and discharges a second capacitor in loop filter 60. Conversely, if the divided signal leads the reference input, the first capacitor is discharged and the second capacitor charged. Loop filter 60 filters the resulting charges on these capacitors to provide a control voltage to a voltage-controlled oscillator (VCO) 65, which in turn provides an output signal that is received by both a mixer 80 and loop divider 50. Loop divider 50 divides the VCO output signal according to a factor N and provides the divided signal to phase detector 45 as discussed previously. In this fashion, PLL 40 keeps the output signal of VCO 65 synchronous with the reference signal provided to phase detector 45. It will be appreciated that the above-described PLL architecture is merely exemplary. Other architectures are known and may be implemented within the present invention such as that used in a set-reset loop filters.

Should an integrated antenna circuit be used to receive signals, the corresponding antenna 35 provides a received signal to a low-noise amplifier (LNA) 67, which in turn provides an amplified received signal to mixer 80. Mixer 80 beats the output signal of VCO 65 with the amplified received signal to produce an intermediate frequency (IF) signal. The antenna-received signal is thus down converted into an IF signal in the well-known super-heterodyne fashion. Because the amplified received signal from LNA 67 is downconverted according to the output signal of VCO 65, the phasing of the resulting IF signal is controlled by the phasing of the reference signal received by PLL 40. By altering the phase of the reference signal, the IF phasing is altered accordingly.

Conversely, if an integrated antenna circuit is used to transmit signals, each mixer 80 up-converts an IF signal according to the output signal (which acts as a local oscillator (LO) signal) from the corresponding VCO 65. The up-converted signal is received by the corresponding antenna 35 using a transmission path (not illustrated) coupling mixer 80 and antenna 35 within each antenna element. Antenna 35 then radiates a transmitted signal in response to receiving the up-converted signal. In this fashion, the transmitted signals are kept phase-locked to reference signals received by phase detectors 45. It will be appreciated that this phase locking may be achieved using other PLL architectures. For example, a set-reset loop filter achieves phase lock using a current controlled oscillator (CCO) rather than a VCO. These alternative PLL architectures are also compatible with the present invention.

A phase management system is used to distribute the reference signals to each integrated antenna circuit. Note that the phase detector 45 in reference antenna circuit 20 receives a reference clock 85 as its reference signal. Reference clock 85 is provided by a master clock circuit (not illustrated). As will be explained further herein, reference antenna circuit 20 includes a programmable phase sequencer 90 to generate the reference signals for slave antenna circuits 25 and 30. Thus, only reference antenna circuit 20 needs to receive externally-generated reference clock 85.

Reference antenna circuit 20 includes an auxiliary loop divider 95 that divides its VCO output signal to provide a reference signal to programmable phase sequencer 90. According to the programming within programmable phase sequencer, it provides a reference signal 91 leading in phase and a reference signal 92 lagging in phase with respect to the reference signal from auxiliary loop divider 95. Slave antenna element 25 receives reference signal 91 whereas slave antenna element 30 receives reference signal 92. Thus, should array 10 be used to transmit, the antenna output from slave element 25 will lead in phase and the antenna output from slave element 30 will lag in phase with respect to the antenna output from reference element 20. This lag and lead in phase will correspond to the phase offsets provided by reference signals 91 and 92 with respect to reference clock 85. Conversely if antenna array 10 is used as a receiver, the IF signals from slave antenna circuits 25 and 30 will lag and lead in phase with respect to the IF signal from reference antenna circuit 20 by amounts corresponding to the phase offsets provided by reference signals 91 and 92 with respect to reference clock 85.

Note the advantages provided by such a phase distribution scheme. The beam steering of the array 10 is provided by a clock distribution scheme to phase-locked loops, a scheme that is entirely amenable to an integrated circuit implementation. In contrast, the conventional corporate feed structure for prior art phased arrays is inherently analog and makes beam steering applications cumbersome to implement. As will be discussed further, programmable phase sequencer 90 allows the programmable phasing to the slave antenna circuits to be performed both conveniently and with precision.

Figure 2:
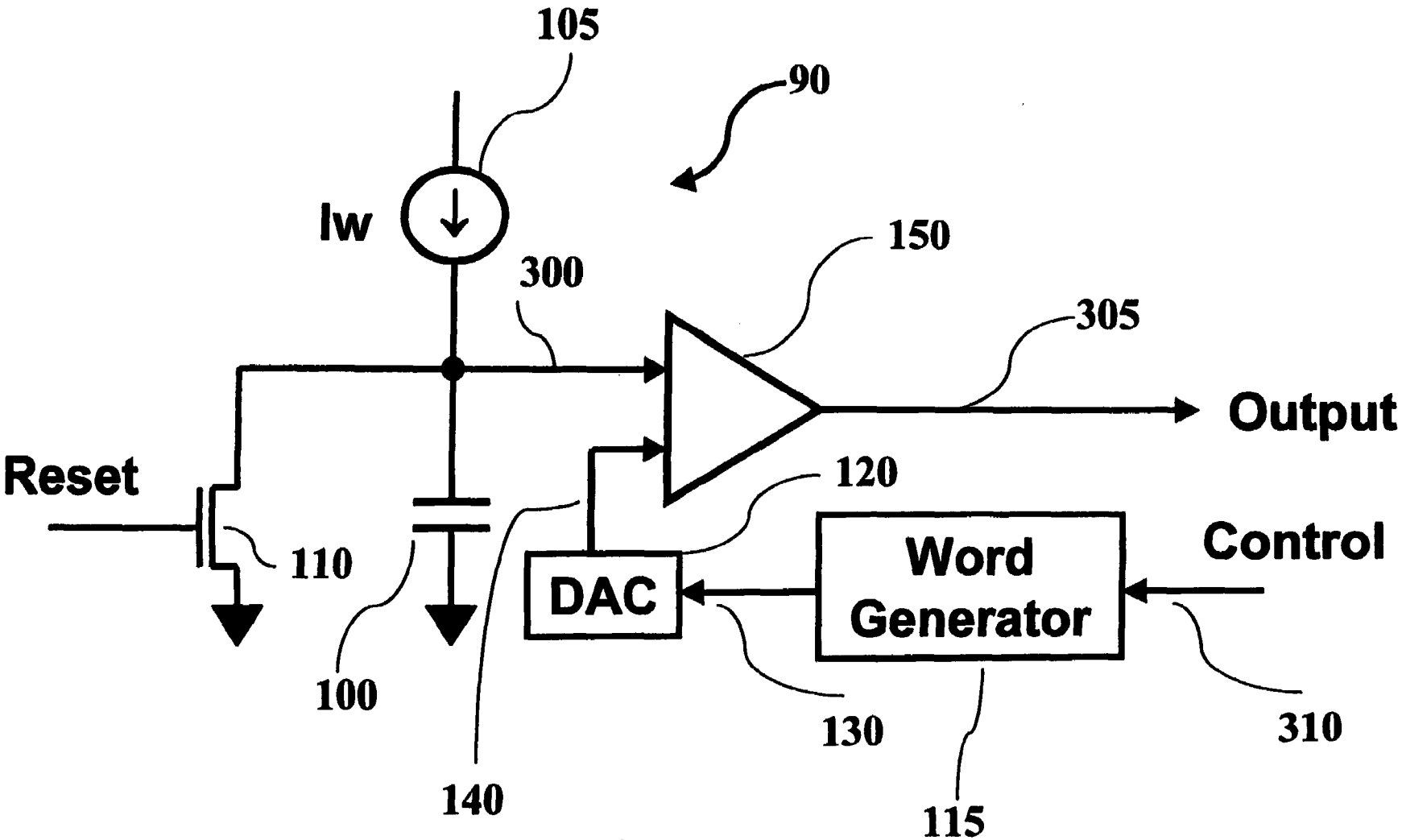
FIG. 2 is a schematic illustration of a programmable phase sequencer according to one embodiment of the invention.

An exemplary implementation for programmable phase sequencer 90 is shown in FIG. 2. A capacitor 100 is charged by a current source 105. The voltage across capacitor 100 will be reset when a transistor 110 coupled in parallel with capacitor 100 becomes conductive. The gate of transistor 110 is pulsed synchronously with the divided output signal from auxiliary loop divider 95 (FIG. 1). Thus, synchronously with each divided output signal cycle, transistor 110 momentarily becomes conductive so as to reset capacitor 100. After reset, transistor 110 turns off so that the voltage across capacitor 100 will thus rise in a linear fashion until the next reset occurs responsive to cycling of the divided output signal. As a result, the voltage across capacitor 100 will possess a sawtooth waveform as seen for sawtooth voltage waveform 300 in FIG. 3.

Referring again to FIG. 2, a programmable digital word generator 115 provides a digital word 130 to a digital-to-analog converter (DAC) 120 responsive to a control signal 310 that determines which digital word 130 will be provided by digital word generator 115. The bit size of the digital words 130 determines the achievable phase-shift resolution. Each digital word 130 is converted by DAC 120 to a corresponding analog voltage 140. For example, if each digital word 130 is four bits, there would be sixteen different analog voltages that may be provided by DAC 120. A comparator 150 compares analog voltage 140 and sawtooth voltage waveform 300 to provide comparator output 305. Depending upon the value of the analog voltage, it will take some delay from reset of capacitor 100 until the voltage builds up enough to cause comparator 150 to assert output 305. If the analog voltage is relatively small, the delay from reset will be relatively small. Conversely, if the analog voltage is relatively large, the delay from reset will be relatively large as well. Accordingly, programmable phase sequencer 90 converts a programmed voltage into a time delay that is proportional to the voltage.

Figure 3:
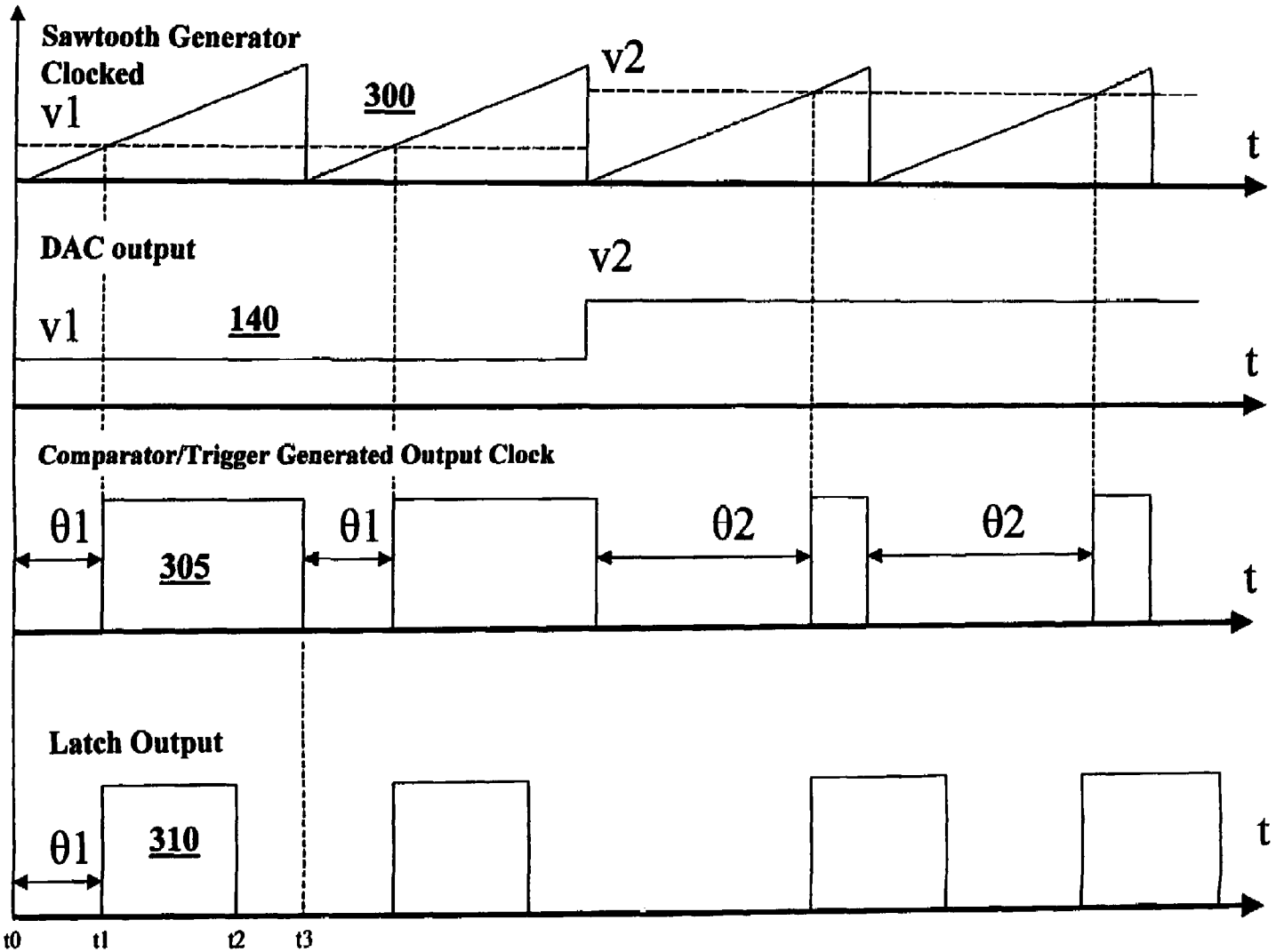
FIG. 3 illustrates voltage waveforms produced by the programmable phase sequencer of FIG. 2.

The resulting phase shift (denoted as $\theta$) may be further explained with respect to FIG. 3. An analog voltage 140 (the DAC output) is shown having two different voltage levels V1 and V2 corresponding to the conversion of two different digital words 130. It will be appreciated that DAC 120 must be configured to provide a voltage within the range of voltages achieved by sawtooth voltage waveform 300. At reset at time $t_0$, sawtooth voltage waveform 300 begins to increase with respect to voltage V1. At time $t_1$, the sawtooth voltage waveform 300 will be larger than voltage V1 such that comparator output 305 goes high. This rising edge of comparator output 305 will be offset from the reset at time $t_0$ by a phase shift $\theta_1$. Upon reset of capacitor 100 at time $t_3$, comparator output 305 will go low again so that the cycle may be repeated.

A latch (not illustrated) may be set at the rising edge of comparator output 305 to provide a clock output 310 as seen in FIG. 3. In this fashion, clock output 310 may have a constant duty cycle as compared to the varying duty cycle of comparator output 305. Clock output 310 may be used as either reference signal 91 or 92 discussed with respect to FIG. 1. A different phase offset will be produced by a different analog voltage such as phase shift $\theta_2$ corresponding to voltage V2 as seen in FIG. 2. In this fashion, depending upon the digital word provided by digital sequencer 115, a desired phase offset may be produced for reference signals 91 and 92 with respect to reference clock 85.

Figure 4A:
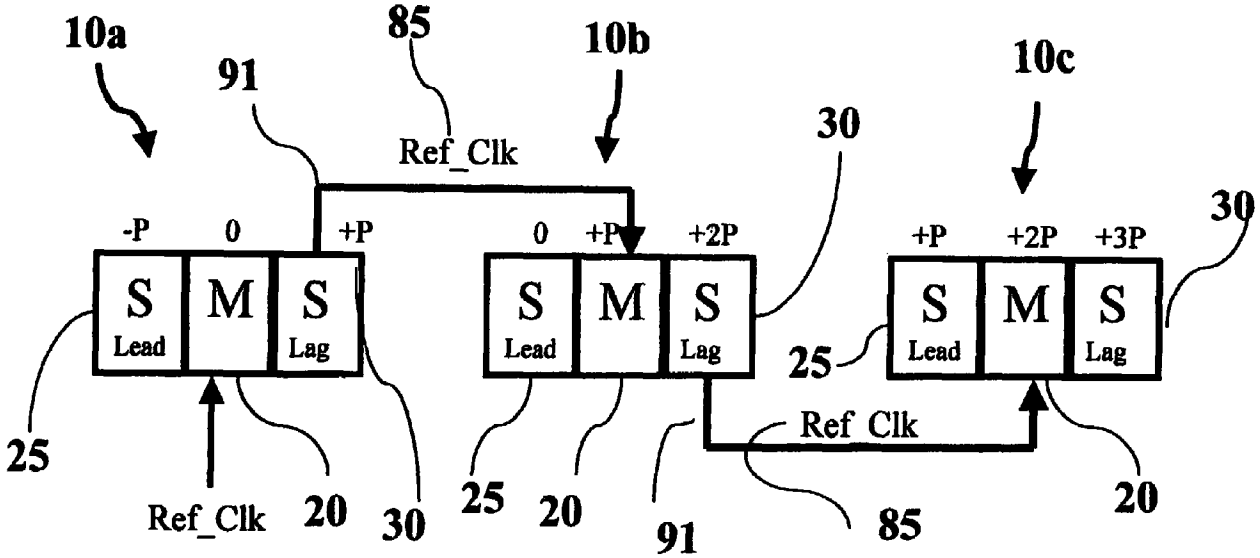
FIG. 4*a* illustrates a phase cascading achieved using multiple antenna arrays according to one embodiment of the invention.
Figure 4B:
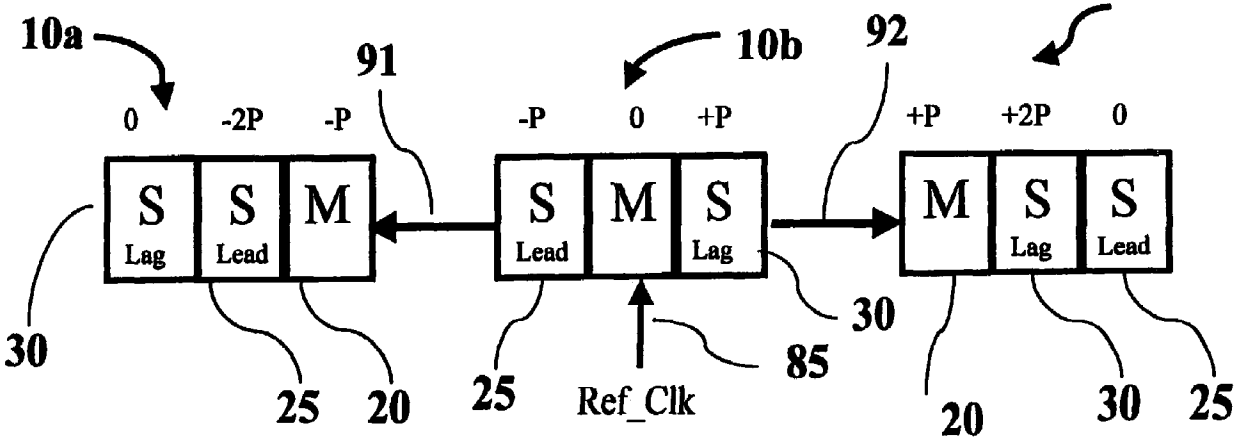
FIG. 4*b* illustrates an alternative phase cascading achieved using the multiple antenna arrays shown in FIG. 4*a*.

The number of clock outputs 305 (and hence reference signals provided to slave antenna circuits) provided by programmable phase sequencer 90 may be increased by simply repeating the circuitry shown in FIG. 2. Moreover, the reference antenna circuit 20 may be replaced by just a master PLL that incorporates a programmable phase sequencer. However, because beam steering typically involves a sequential and regular phase progression, it is convenient to construct an antenna array using two slave antenna circuits as discussed with respect to FIG. 1. In other words, a common beam steering phase progression for an arbitrary phase difference P would be −P, 0, +P for an array of three antennas. This phase progression may then be cascaded to other master/slave integrated antenna circuit combinations as seen in FIG. 4*a*. Each master/slave antenna array 10 has a master antenna circuit 20 and slave antenna circuits 25 and 30 as discussed with respect to FIG. 1. Within each array 10, the reference signal to slave antenna circuit 30 lags and slave antenna circuit 25 leads the reference signal provided to master antenna circuit 20 by a phase increment P. From array 10*a*, the lag clock 91 discussed with respect to FIG. 1 is provided to master antenna circuit 20 of array 10*b* as its reference clock 85. Thus, the phasing across array 10*b* becomes 0, P, and, 2P as shown. In turn, the lead clock 91 from array 10*b* is provided to master antenna circuit 20 of array 10*c* as its reference clock 85 so that the phasing across array 10*c* becomes P, 2P, and 3P as shown. By using different metal layers for clock lag 92 and lead 91 routing, various versions of phase cascading may be provided using arrays 10. For example, using other metal layers, arrays 10 may be configured for the phase progression shown in FIG. 4*b*. Master antenna circuit 20 in array 10*b* receives a reference clock 85. The lead clock 91 from slave antenna circuit 25 in array 10*b* is fed as the reference clock for master antenna circuit 20 in array 10*a*. Similarly, the lag clock 92 from slave antenna circuit 30 in array 10*b* is fed as the reference clock for master antenna circuit 20 in array 10*c*. In this fashion, a phase progression of −2P, −P, 0, P, and 2P may be achieved across arrays 10. It will be appreciated that the static phase progression described with respect to FIGS. 4*a* and 4*b* may be altered by adjusting the phase progression provided by programmable phase sequencer 90 within each master antenna circuit 20.

Figure 10:
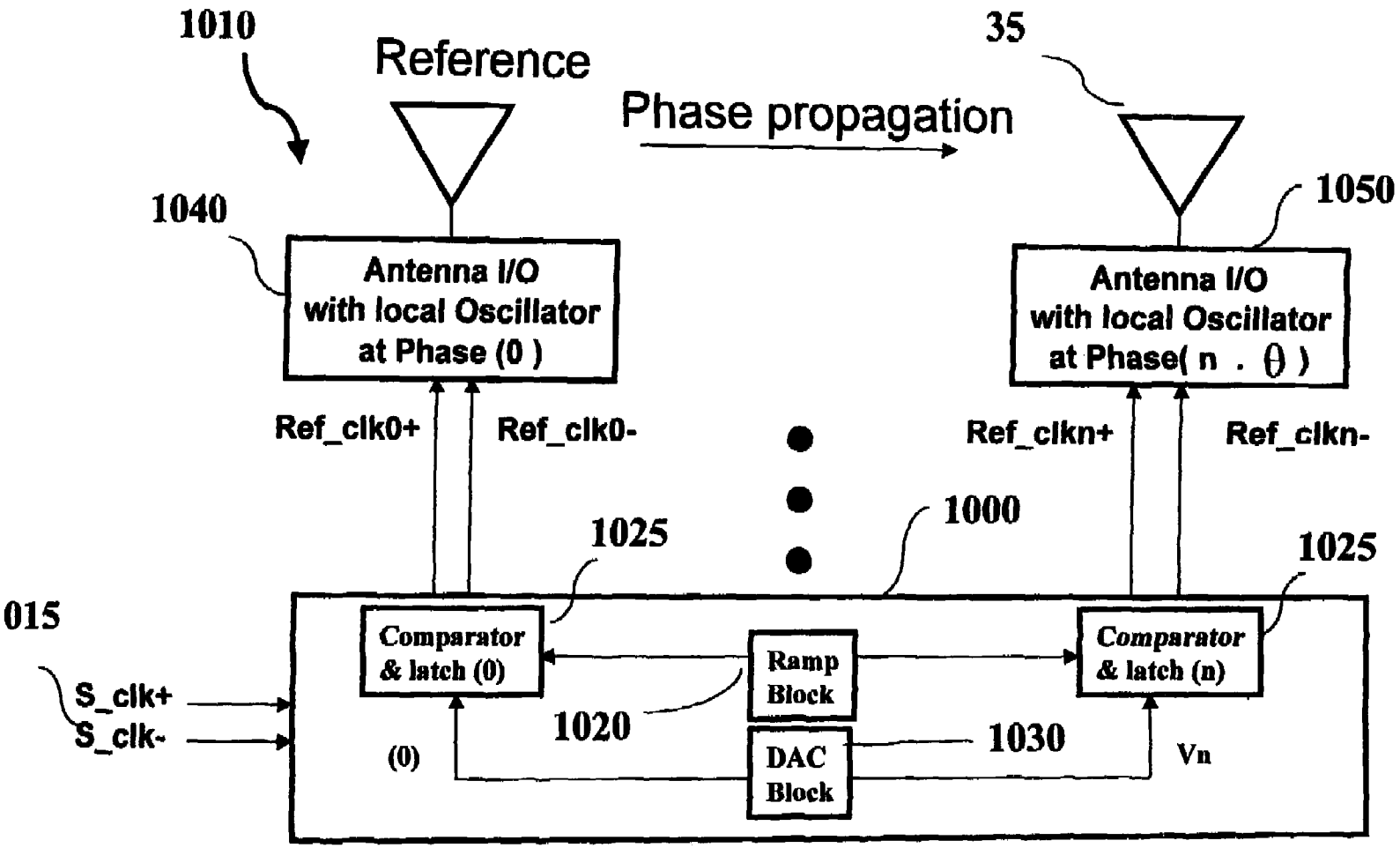
FIG. 10 is a block diagram of an antenna array having a centralized phase progression according to one embodiment of the invention.

Referring again to FIG. 1, PLLs 40 may be replaced with differential PLLs to provide more robust common-mode noise rejection as known in the art. In such embodiments, the reference clock signal provided to the master PLL would be in differential form. In turn, the phase-shifted versions of this reference clock provided by the programmable phase sequencer would be in differential form as well. Moreover, the programmable phase sequencer need not be integrated into within the feedback loop of a PLL as shown in FIG. 1. Instead, as shown in FIG. 10, a centralized programmable phase sequencer 1000 may be used to provide differential reference clocks to integrated antenna circuits 1010. Phase sequencer 1000 receives a master differential clock 1015 which is used to reset a ramped voltage on a capacitor as discussed with respect to FIG. 2 and represented by ramp circuitry block 1020. To provide each reference clock, a comparator and latch combination 1025 responds to an analog voltage in an analogous fashion as discussed with respect to FIG. 2. A DAC circuitry block 1030 includes a programmable digital word sequencer that provides digital words to digital-to-analog converters to provide the analog voltages. Each integrated antenna circuit includes a PLL which responds to its reference clock as discussed with respect to PLLs 40 in slave antenna units 25 and 30 in FIG. 1. The resulting phase progression across the integrated antenna circuits may be described with respect to a reference integrated antenna circuit 1040, which may be deemed to respond to a phase (0). The remaining integrated antenna circuits may be considered as progressing in phase from phase (0). For example, assuming that a uniform phase progression denoted as θ is implemented, an nth integrated antenna circuit 1050 would operate with a phase of (n*θ). It will be appreciated that a non-uniform phase progression or single-ended PLLs may also be implemented in such a centralized phase progression scheme.

Figure 5:
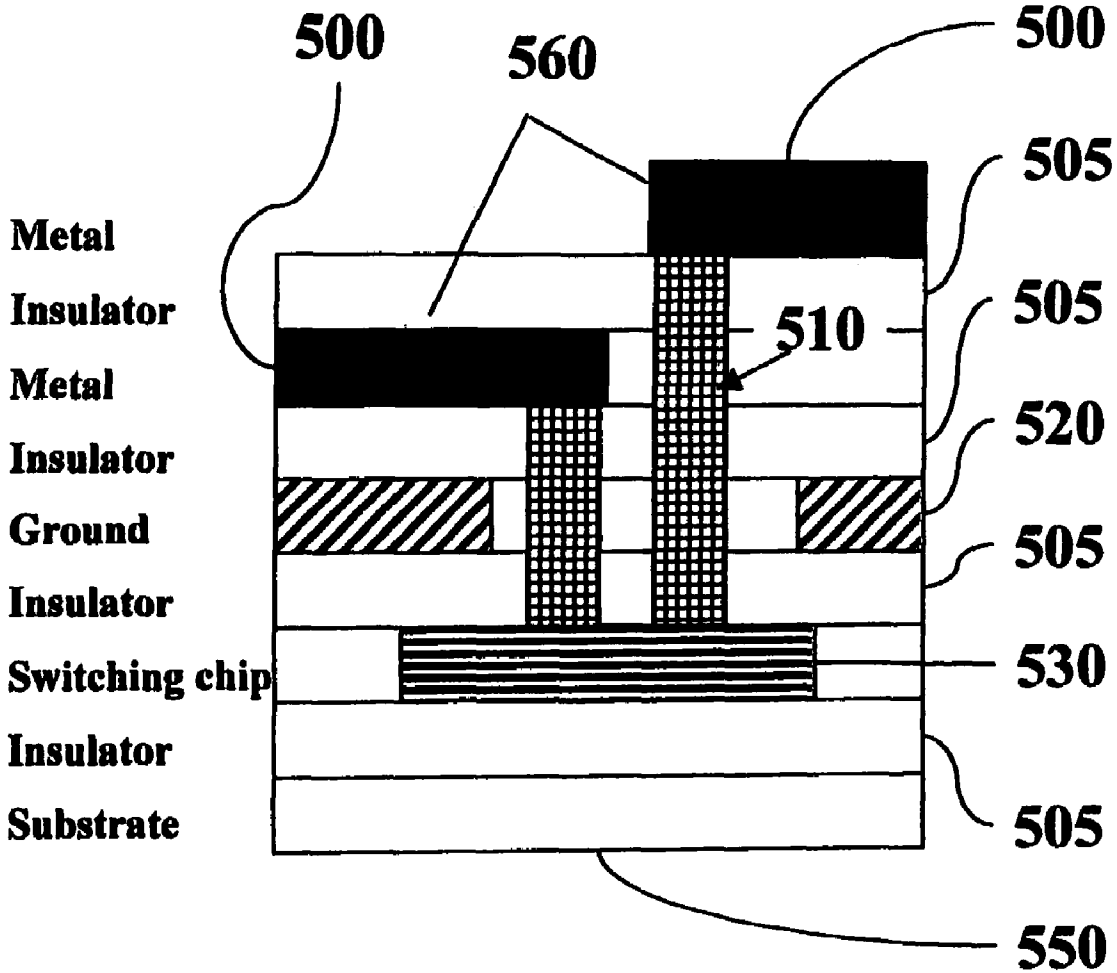
FIG. 5 is a cross-sectional view of a T-shaped dipole antenna which may be used as in the integrated antenna circuits of FIG. 1.

Each antenna 35 within the arrays of integrated antenna circuits may be formed using conventional CMOS processes as discussed in the '160 application for patch and dipole configurations. For example, as seen in cross section in FIG. 5, antenna 35 may be configured as a T-shaped dipole antenna 500. T-shaped antenna 500 is excited using vias 510 that extend through insulating layers 505 and through a ground plane 520 to driving transistors formed on a switching layer 530 separated from a substrate 550 by an insulating layer 505. Two T-shaped antenna elements 500 may be excited by switching layer 530 to form a dipole pair 560. To provide polarization diversity, two dipole pairs 560 may be arranged such that the transverse arms in a given dipole pair are orthogonally arranged with respect to the transverse arms in the remaining dipole pair.

Depending upon the desired operating frequencies, each T-shaped antenna element 500 may have multiple transverse arms. The length of each transverse arm is approximately one-fourth of the wavelength for the desired operating frequency. For example, a 2.5 GHz signal has a quarter wavelength of approximately 30 mm, a 10 GHz signal has a quarter wavelength of approximately 6.75 mm, and a 40 GHz signal has a free-space quarter wavelength of 1.675 mm. Thus, a T-shaped antenna element 500 configured for operation at these frequencies would have three transverse arms having fractions of lengths of approximately 30 mm, 6.75 mm and 1.675 mm, respectively. The longitudinal arm of each T-shaped element may be varied in length from 0.01 to 0.99 of the operating frequency wavelength depending upon the desired performance of the resulting antenna. For example, for an operating frequency of 105 GHz, a longitudinal arm may be 500 micrometers in length and a transverse arm may be 900 micrometers in length using a standard semiconductor process. In addition, the length of each longitudinal arm within a dipole pair may be varied with respect to each other. The width of longitudinal arm may be tapered across its length to lower the input impedance. For example, it may range from 10 micrometers in width at the via end to hundreds of micrometers at the opposite end. The resulting input impedance reduction may range from 800 ohms to less than 50 ohms.

Each metal layer forming T-shaped antenna element 500 may be copper, aluminum, gold, or other suitable metal. To suppress surface waves and block the radiation vertically, insulating layer 505 between the T-shaped antenna elements 500 within a dipole pair may have a relatively low dielectric constant such as $\in$=3.9 for silicon dioxide. The dielectric constant of the insulating material forming the remainder of the layer holding the lower T-shaped antenna element 500 may be relatively high such as $\in$=7.1 for silicon nitride, $\in$=11.5 for $Ta_2O_3$, or $\in$=11.7 for silicon. Similarly, the dielectric constant for the insulating layer 505 above ground plane 520 may also be relatively high (such as $\in$=3.9 for silicon dioxide, $\in$=11.7 for silicon, $\in$=11.5 for $Ta_2O_3$).

Figure 6:
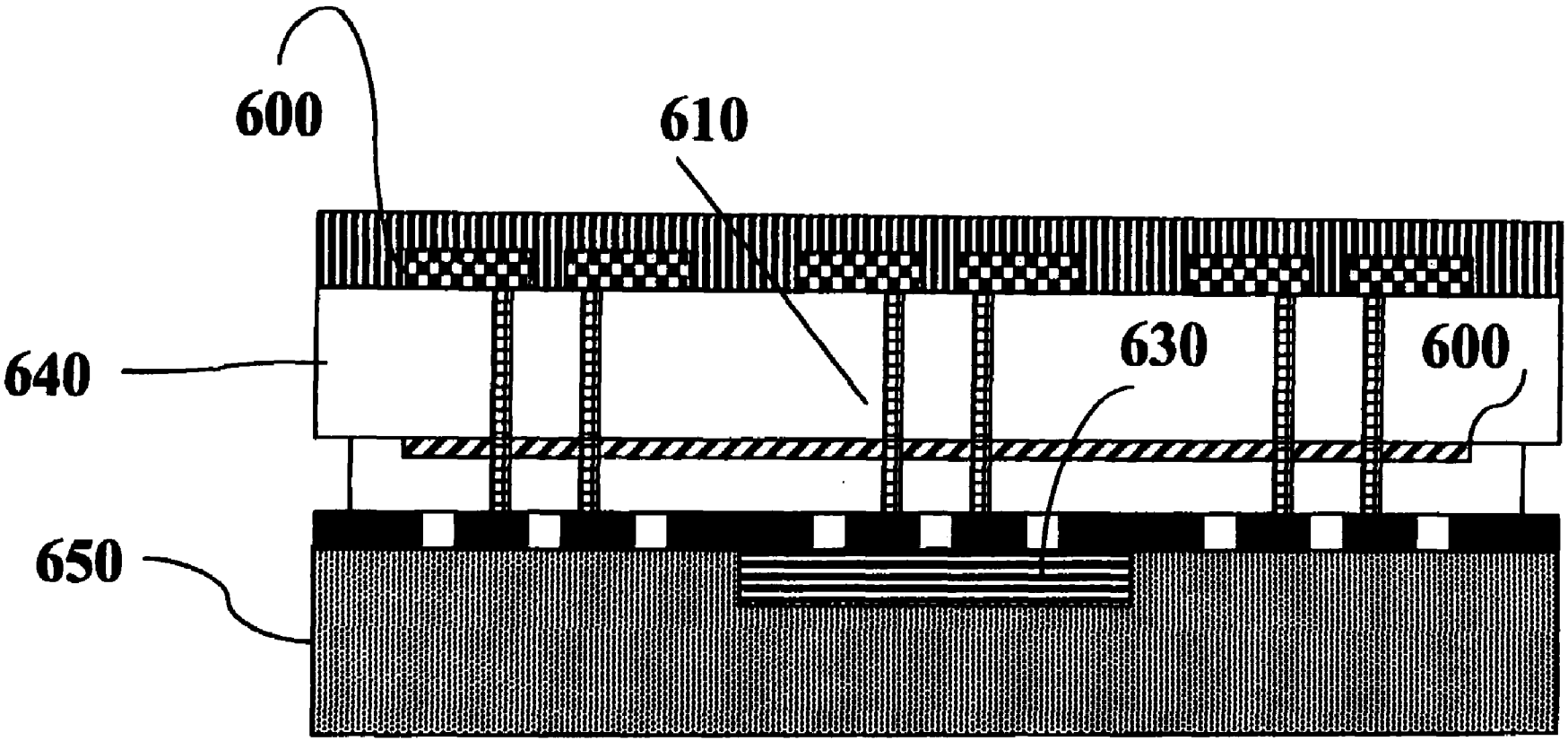
FIG. 6 is a cross-sectional view of an antenna element having a relatively thick dielectric layer to reduce coupling between the antenna and the substrate.

The quarter wavelength discussion with respect to the T-shaped dipole antenna 500 may be generally applied to other antenna topologies such as patch antennas. However, note that it is only at relatively high frequencies such as the upper bands within the W band of frequencies that the quarter wavelength of a carrier signal in free space is comparable or less than the thickness of substrate 550. Accordingly, at lower frequencies, integrated antennas should be elevated away from the substrate by using an interim passivation layer. Such an embodiment for a T-shaped antenna element 600 is shown in FIG. 6. Silicon substrate 650 includes RF driving circuitry 630 that drives a T-shaped dipole antenna 600 through vias 610 analogously as discussed with respect to antenna 500. However, a grounded shield is separated from the T-shaped dipole antenna elements 600 by a relatively thick dielectric layer 640. For example, dielectric layer 640 may be 1 to 2 mm in thickness.

Regardless of the particular antenna topology implemented, arrays of antennas may be driven using the phase management techniques disclosed herein. The phase management techniques disclosed so far are quite accurate but require a PLL for each antenna being phased. As will be described further herein, rather than use a PLL, phase management may be performed using just amplification and the fixed phase provided by a corporate feed. For example, consider an array 700 shown in FIG. 7, wherein a fixed-phase feed network 705 maintains the transmitted and received signals 90 degrees out of phase. For example, a received signal from an antenna 710 will couple through network 705 to be received at a beamforming circuit 715 leading in phase ninety degrees with respect to a received signal from an antenna 720. Examples of such a fixed-phase feed network may be seen in PCMCIA cards, wherein one antenna is maintained 90 degrees out of phase with another antenna to provide polarization diversity. However, rather than implement a complicated MEMs-type steering of antenna elements 705 and 720 as would be conventional in the prior art, variable gain provided by variable-gain amplifiers 725 and 730 electronically provides beam steering capability. Amplifiers 725 and 730 provide again-adjusted output signals 726 and 731, respectively, to a summing circuit 740. Summing circuit 740 provides the vector sum of the gain-adjusted output signals from amplifiers 725 and 730 as output signal 750. Variable-gain amplifiers 725 and 730 may take any suitable form. For example, amplifiers 725 and 730 may be implemented as Gilbert cells. A conventional Gilbert cell amplifier is constructed with six bipolar or MOS transistors (not illustrated) arranged as a cross-coupled differential amplifier. Regardless of the particular implementation for variable-gain amplifiers 725 and 730, a controller 760 varies the relative gain relationship between the variable gain amplifiers to provide a desired phase relationship in the output signal 750. This phase relationship directly applies to the beam steering angle achieved. For example, should controller 760 command variable-gain amplifiers 725 and 730 to provide gains such that their outputs 726 and 731 have the same amplitudes, the resulting phase relationship between signals 726 and 731 is as shown in FIG. 8. Such a relationship corresponds to a beam-steering angle $\phi_1$ of 45 degrees. However, by adjusting the relative gains amplifiers 725 and 730, alternative beam-steering angles may be achieved. For example, by configuring amplifier 730 to invert its output and reducing the reducing the relative gain provided by amplifier 725, a beam-steering angle $\phi_2$ of approximately −195 degrees may be achieved. In this fashion, a full 360 degrees of beam steering may be achieved through appropriate gain and inversion adjustments.

Similarly, a full 360 degrees of beam steering may be achieved for transmitted signals. As seen in FIG. 9, variable gain amplifiers 905 and 910 receive an identical RF feed and adjust the gains of output signals 906 and 911, respectively, in response to gain commands from controller 760. Fixed-phase feed network 705 delays the phase of signal 906 ninety degrees with respect to signal 911 before they are received by antennas 720 and 710, respectively. Depending upon the relative gains and whether amplifiers 905 and 910 are inverting, a full 360 degrees of beam steering may be achieved as discussed with respect to FIG. 8.

Figure 7:
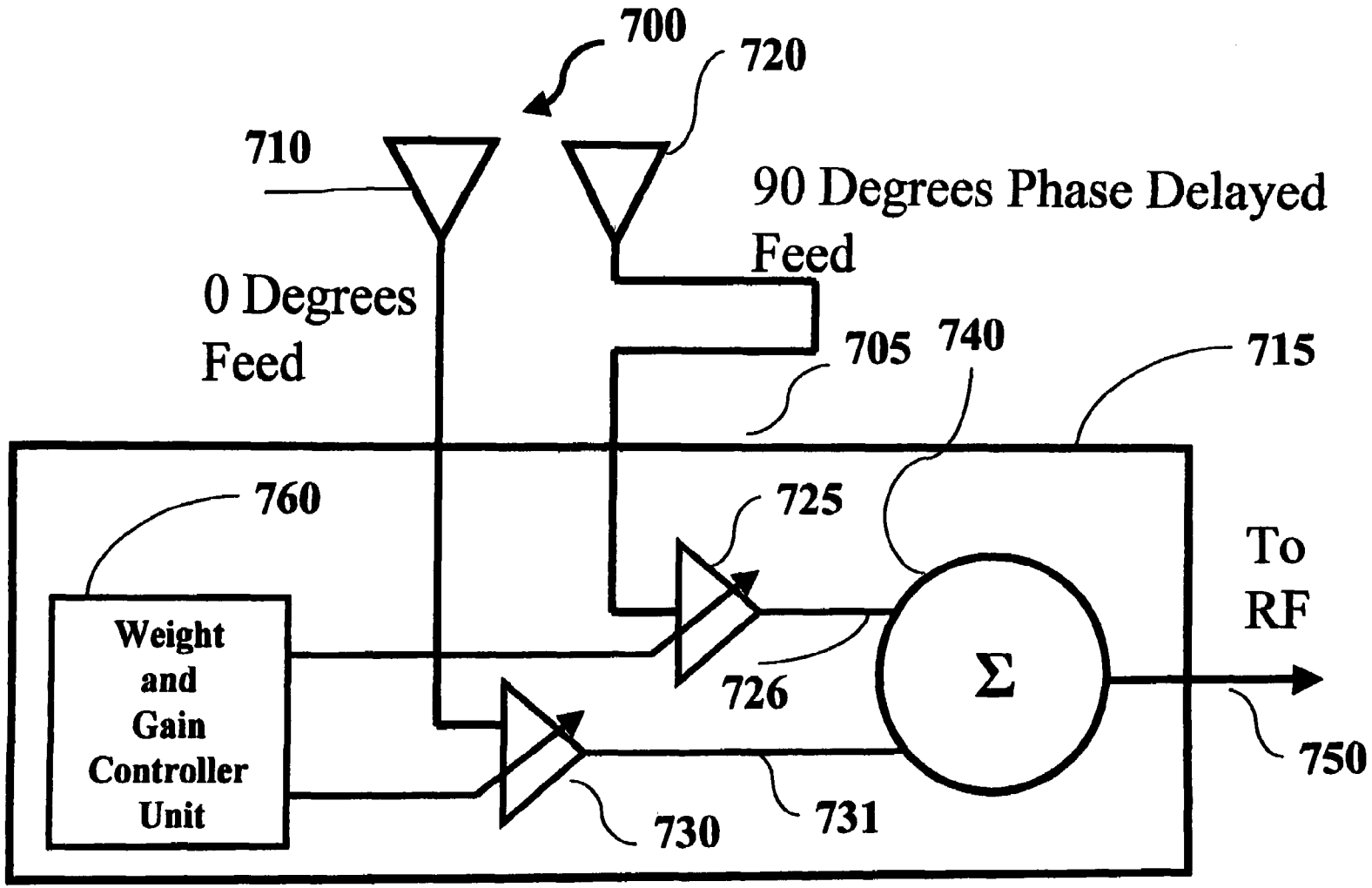
FIG. 7 is a block diagram of an antenna array having a fixed-phase feed network configured to provide beam steering of received signals through gain adjustments according to one embodiment of the invention.
Figure 8:
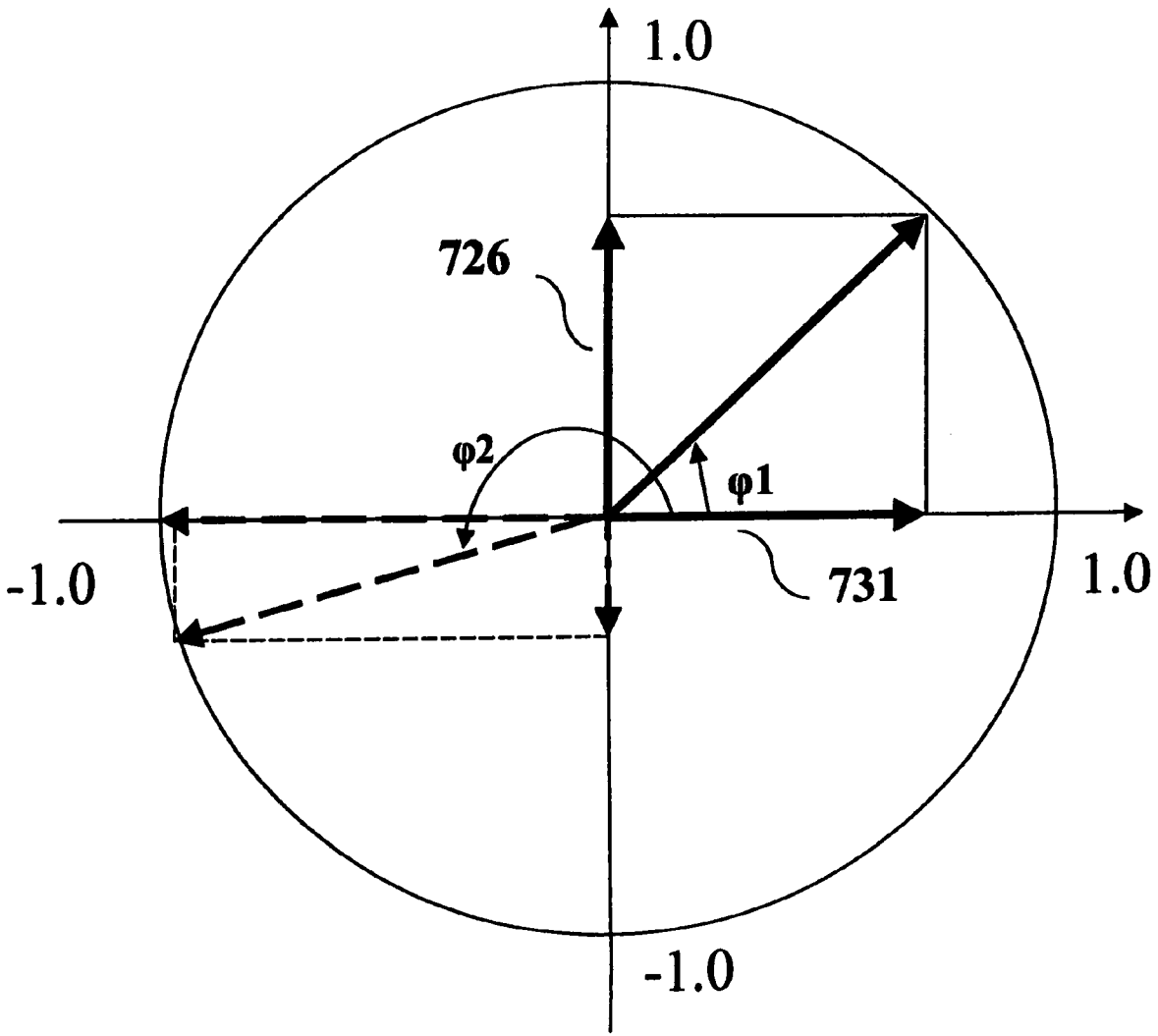
FIG. 8 illustrates the beam-steering angles achieved by the antenna array of FIG. 7 for a variety of gain settings.
Figure 9:
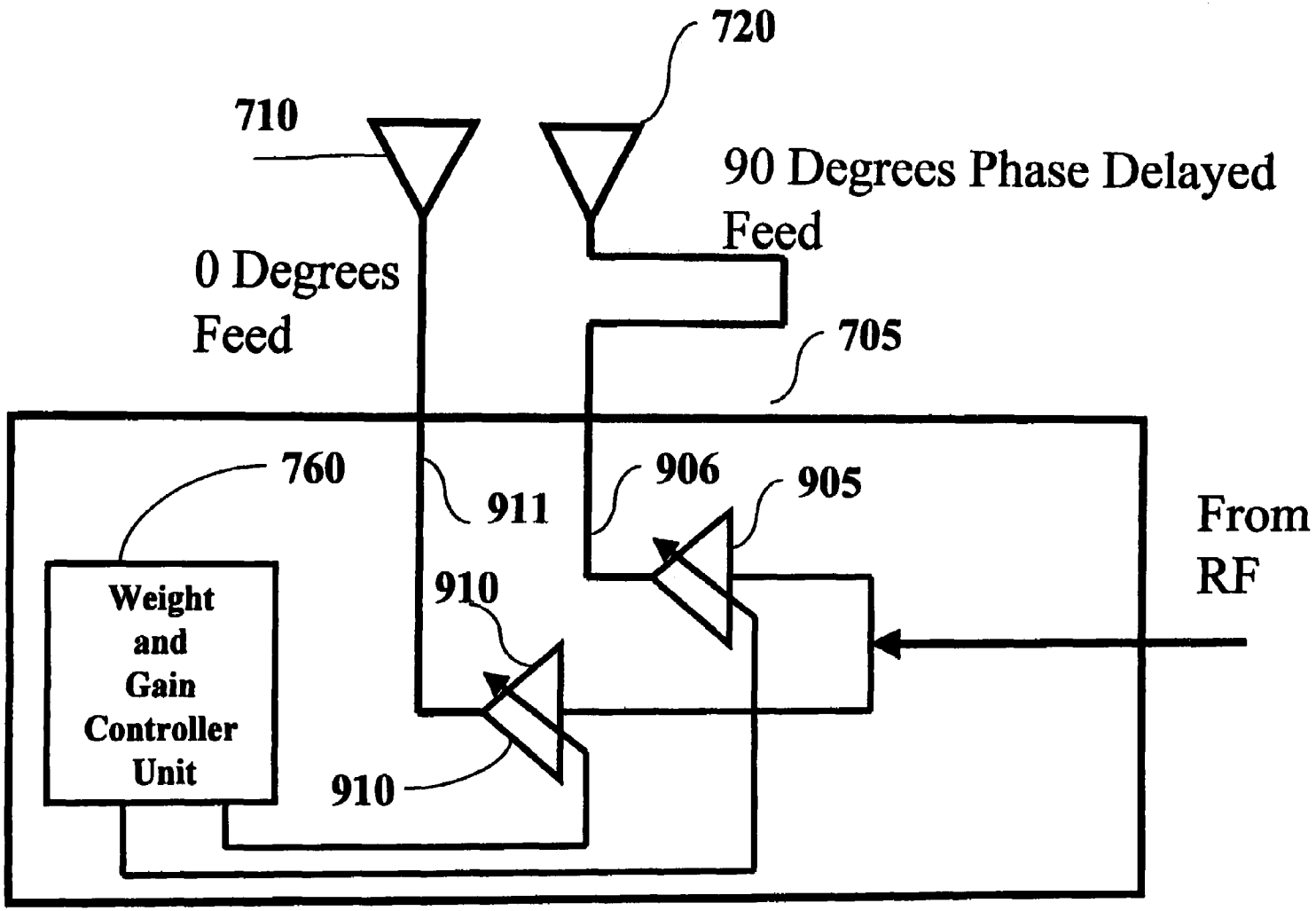
FIG. 9 is a block diagram of an antenna array having a fixed-phase feed network configured to provide beam steering of transmitted signals through gain adjustments according to one embodiment of the invention.

It will be appreciated that the gain-based beam-steering described with respect to FIGS. 7, 8, and 9 may be applied to an array having an arbitrary number of antennas. Regardless of the number of antennas, a fixed-phase feed network keeps the received and transmitted signals from the antennas separated in phase by fixed amounts. During reception, the fixed phase separation is exploited by adjusting the gains before combining the phase-separated and gain-adjusted signals. Similarly, during transmission, the fixed phase separation is exploited by adjusting the gains of the feed signals to fixed-phase feed networks.

The above-described embodiments of the present invention are merely meant to be illustrative and not limiting. It will thus be obvious to those skilled in the art that various changes and modifications may be made without departing from this invention in its broader aspects. The appended claims encompass all such changes and modifications as fall within the true spirit and scope of this invention.

I claim:

1. An integrated beam-forming system, comprising:

a substrate;

a plurality of oscillators formed in the substrate;

a phase generator formed in the substrate; and a plurality of antennas formed adjacent the substrate, wherein each oscillator is coupled to a corresponding at least one of the antennas, and wherein the phase generator is operable to provide a plurality of uniquely-phased reference clocks, each oscillator being coupled to the phase generator to receive a different one of the uniquely-phased reference clocks.

2. The integrated beam-forming system of claim 1, wherein the phase generator is further operable to provide the uniquely-phased reference clocks such that an IF signal received by the oscillators mixers is phase-shifted according to the unique phases of the reference clocks to provide a plurality of phase-shifted RF signals for transmission by the antennas.

3. The integrated beam-forming system of claim 2, wherein each antenna is a patch antenna.

4. The integrated beam-forming system of claim 2, wherein each antenna is a dipole antenna.

5. The integrated beam-forming system of claim 4, wherein each dipole antenna is a T-shaped dipole antenna.

6. The integrated beam-forming system of claim 2, wherein the substrate is an entire semiconductor wafer.

* * * * *